US009165755B2

(12) United States Patent
Remes et al.

(10) Patent No.: US 9,165,755 B2
(45) Date of Patent: Oct. 20, 2015

(54) METHODS FOR PREDICTIVE AUTOMATIC GAIN CONTROL FOR HYBRID MASS SPECTROMETERS

(71) Applicant: Thermo Finnigan LLC, San Jose, CA (US)

(72) Inventors: Philip M. Remes, San Jose, CA (US); Michael W. Senko, Sunnyvale, CA (US); Justin Blethrow, Oakland, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/297,092

(22) Filed: Jun. 5, 2014

(65) Prior Publication Data

US 2014/0361158 A1 Dec. 11, 2014

Related U.S. Application Data

(60) Provisional application No. 61/832,346, filed on Jun. 7, 2013.

(51) Int. Cl.

| | |
|---|---|
| ***H01J 49/00*** | (2006.01) |
| ***H01J 49/26*** | (2006.01) |
| ***H01J 49/42*** | (2006.01) |

(52) U.S. Cl.

CPC ..... *H01J 49/4265* (2013.01); *H01J 49/004* (2013.01); *H01J 49/0009* (2013.01); *H01J 49/0027* (2013.01); *H01J 49/0031* (2013.01); *H01J 49/0036* (2013.01); *H01J 49/26* (2013.01)

(58) Field of Classification Search

CPC ..... H01J 49/4265; H01J 49/0036; H01J 49/0009; H01J 49/0027; H01J 49/004; H01J 49/0031

See application file for complete search history.

(56) References Cited

U.S. PATENT DOCUMENTS

| | | | | |
|---|---|---|---|---|
| 5,107,109 | A | 4/1992 | Stafford, Jr. et al. | |
| 5,572,022 | A | 11/1996 | Schwartz et al. | |
| 5,936,241 | A | 8/1999 | Franzen et al. | |
| 6,884,996 | B2 * | 4/2005 | Senko | 250/282 |
| 6,987,261 | B2 | 1/2006 | Horning et al. | |
| 7,109,474 | B2 * | 9/2006 | Schwartz | 250/282 |
| 7,297,941 | B2 | 11/2007 | Senko et al. | |
| 7,312,441 | B2 * | 12/2007 | Land et al. | 250/282 |
| 7,638,763 | B2 | 12/2009 | Guckenberger et al. | |

(Continued)

OTHER PUBLICATIONS

Anonymous, "Method for Estimating Isolation Efficiency," Research Disclosure, ISSN 0374-4353, (2013), pp. 1-7.

(Continued)

*Primary Examiner* — Michael Logie
(74) *Attorney, Agent, or Firm* — Thomas F. Cooney

(57) ABSTRACT

A method for mass analyzing ions comprising a restricted range mass-to-charge (m/z) ratios comprising (i) performing a survey mass analysis, using a first mass analyzer employing indirect detection of ions by image current detection, to measure a flux of ions having m/z ratios within said range and (ii) performing a dependent mass analysis, using a second mass analyzer, of an optimal quantity of ions having m/z ratios within said range, said optimal quantity collected for a time period determined by the measured ion flux, the method characterized in that: the time period is determined using a corrected ion flux that includes a correction that comprises an estimate of the quantity of ions that are undetected by the first mass analyzer.

2 Claims, 15 Drawing Sheets

(56) References Cited

U.S. PATENT DOCUMENTS

| | | | | |
|---|---|---|---|---|
| 7,728,288 | B2 | 6/2010 | Makarov et al. | |
| 7,928,373 | B2 | 4/2011 | Quarmby et al. | |
| 7,960,690 | B2 * | 6/2011 | Schwartz et al. | 250/282 |
| 8,053,723 | B2 | 11/2011 | Senko | |
| 8,410,424 | B2 * | 4/2013 | Makarov et al. | 250/281 |
| 2009/0194682 | A1 * | 8/2009 | Zhang et al. | 250/282 |
| 2010/0019144 | A1 * | 1/2010 | Schwartz et al. | 250/283 |
| 2010/0282957 | A1 * | 11/2010 | Wouters et al. | 250/252.1 |
| 2012/0032072 | A1 * | 2/2012 | Quarmby et al. | 250/282 |
| 2012/0292498 | A1 * | 11/2012 | Jiang et al. | 250/282 |
| 2013/0062518 | A1 * | 3/2013 | Makarov et al. | 250/282 |
| 2014/0061460 | A1 * | 3/2014 | Hauschild et al. | 250/283 |
| 2014/0138537 | A1 * | 5/2014 | Grothe et al. | 250/282 |
| 2014/0306107 | A1 * | 10/2014 | Remes et al. | 250/283 |

OTHER PUBLICATIONS

Remes et al, "Methods for Predictive Automatic Gain Control for Hybrid Mass Spectrometers," U.S. Appl. No. 14/251,137, Office Action mailed Jan. 27, 2015.

Remes et al, "Methods for Predictive Automatic Gain Control for Hybrid Mass Spectrometers," U.S. Appl. No. 14/251,137, Pending Claims as of May 26, 2015.

* cited by examiner

METHODS FOR PREDICTIVE AUTOMATIC GAIN CONTROL FOR HYBRID MASS SPECTROMETERS

CROSS-REFERENCE TO RELATED APPLICATIONS

This application claims, under 35 U.S.C. 119(e), the benefit of the filing date of U.S. Provisional Application for Patent No. 61/832,346, filed on Jun. 7, 2013 and titled "Methods for Predictive Automatic Gain Control for Hybrid Mass Spectrometers", said Provisional Application assigned to the assignee of this application and hereby incorporated by reference herein in its entirety.

FIELD OF THE INVENTION

This invention relates to methods for controlling ion population in a mass spectrometer and, more particularly, to controlling ion population using information from a survey acquisition corrected for ion transfer efficiencies across and between system components. The invention further relates to methods for predicting the flux of ions, as it relates to mass, between components in hybrid mass spectrometer instruments.

BACKGROUND OF THE INVENTION

For mass spectrometers, especially trapping type instruments, controlling the ion population is an important task. Trapping instruments operate most effectively when the number of ions in them is maintained within a certain range, and the well known automatic gain control (AGC) method was developed to control the ion population, thus increasing dynamic range. In a most basic sense, the time required to fill a mass spectrometer component, such as an ion trap, to its optimal ion population level is estimated from a prior measurement of ion flux into the component. In the widely used data-dependent experimental scheme, an initial "survey" scan is used to identify interesting features eluting from a liquid chromatograph (LC) and, subsequently, several (in the range of 10-50) "dependent" mass scans—which may comprise tandem mass spectral scans ($MS^n$)—are performed to interrogate the precursor species identified in the survey scan. If the instrument is a hybrid type, having more than one type of mass analyzer, then the duty cycle can be increased by using one analyzer for the survey scan, and another for the dependent $MS^n$ scans.

Automatic gain control methods are described, for example, in U.S. Pat. No. 5,572,022, issued Nov. 5, 1996 in the names of inventors Schwartz et al., U.S. Pat. No. 5,936,241, issued Aug. 10, 1999 in the names of inventors Franzen and Schubert, U.S. Pat. No. 7,312,441 B2 issued Dec. 25, 2007 in the names of inventors Land et al., and U.S. Pre-Grant Patent Application Publication 2010/0282957 A1, published on Nov. 11, 2010 in the names of inventors Wouters et al., all of these documents hereby incorporated by reference herein in their entireties. The basic premise of AGC is that the ion flux entering the instrument does not change significantly in the time between taking data acquisitions that are closely spaced in time, and so an accumulation time for acquisition $A_i$ can be predicted from a previous acquisition $A_0$. Although this method is most useful for trapping type instruments, such as quadrupole ion traps (QITs), Orbitrap™ mass analyzers (OTs), and Penning traps, even non-trapping instruments such as time of flight (TOF) have been known to control a parameter based on previous acquisitions to attenuate the ion beam, thereby increasing dynamic range. For a trapping instrument, the known AGC methods may estimate an accumulation time for $A_i$ using the following Eq. 1, where $t_i$ and $t_0$ are accumulation times for $A_i$ and $A_0$, $I_0$ is an intensity value proportional to ions from $A_0$, and $I_{target}$ is a target intensity value for $A_i$.

$$t_i = \frac{N_{target}}{F} = \frac{t_0}{I_0} I_{target} \qquad \text{Eq. 1}$$

In the above equation, the quantity $N_{target}$ is a desired or optimal population of ions in the trap and F is the incident ion flux (in number of ions per second).

One problem with the known techniques is that, to make an accurate estimation, the instrument must be operated in the same mode during $A_0$ as for $A_i$. Frequently, however, this is not the case. If a hybrid mass analyzer is employed, a problem can arise when the isolation efficiency of the $MS^n$ stages are significantly less than unity. In at least these types of cases, the prediction of ion flux from the survey scan may be inaccurate. For example, consider FIG. 1, showing a hypothetical survey scan with three species of different intensities (having centroids 111-113) at (relative) mass values of −1.0, 0.0 and +1.0, wherein the targeted species is located at 0.0 Da. In this example, the dependent scan isolation window 114 is 1.6 Da wide, as is denoted by the dashed lines. The dependent scans use the abundance information from the survey scan to estimate the ion flux, so that the ion accumulation time can be set appropriately for a target ion population size. That general procedure has been termed "predictive automatic gain control". In the situation shown in FIG. 1, information about the isolation efficiency in the $MS^n$ stages is not available from the survey scan spectrum. Some of the ions from the species at −1.0 and 1.0 may actually be present in the dependent scan using the indicated isolation window (within the dashed lines), causing the estimation of ion flux to be too low, and an estimated accumulation time that is too high.

SUMMARY

Ion populations in trapping instruments are controlled by using intensity information in previous survey data acquisition $A_0$ to predict appropriate accumulation times for subsequent dependent acquisition $A_i$ (i=1, 2, . . . n). The acquisitions $A_0$ and $A_i$ may use different instrumental parameters, for instance, $A_0$ may be inclusive of a wide range of mass-to-charge, while $A_i$ may be targeted to a specific analyte(s). The ion flux to a mass analyzer is therefore different for the different acquisitions. However, an accurate prediction of ion flux to an analyzer for acquisition $A_i$ can be made by having previously characterized and parameterized the transfer efficiency through the instrument, such that the ratio of transfer efficiencies or signal intensities for the different conditions is known.

In another aspect of the present teachings, methods are described for predicting the flux of ions in hybrid instruments. After having characterized the analyzer that does isolation for selected ion monitoring (SIM) or tandem mass spectrometry (MS/MS or, more generally, $MS^n$), centroid data from a different mass analysis device from the one used for the survey can be used to estimate the flux of ions in a given mass window. This is useful for accurately estimating accumulation times from survey acquisitions, in a predictive automatic gain control procedure.

In yet another aspect of the present teachings, methods are described for correcting survey mass spectrometric data collected for the purpose of determining ion flux for the presence of "mass spectrometric dark matter" which comprises ion species that, although they may not be detected, nonetheless contribute to charge density within mass spectrometer components.

BRIEF DESCRIPTION OF THE DRAWINGS

The above noted and various other aspects of the present invention will become apparent from the following description which is given by way of example only and with reference to the accompanying drawings, not drawn to scale, in which:

FIG. 14B is a chart the ratio of Actual/Target number of ions versus retention time for experiments performed using injection time estimates based on Orbitrap survey scans, with the Orbitrap mass spectrometric dark matter correction ON.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1-15, taken in conjunction with the following description.

A particularly useful and efficient mode of operation uses acquisition $A_0$ to estimate the abundance of several analyte species at once, so that acquisitions $A_i$ (i=1, 2, . . . n), all use intensity information from $A_0$. In this case, $A_0$ is called the master or survey acquisition, and $A_i$ is called a dependent acquisition. In such a scenario, $A_0$ might use an instrument mode that allows analytes over broad range of mass-to-charge to be transmitted, while $A_i$ would be targeted for a specific analyte or set of analytes, in a selected ion monitoring (SIM) or tandem MS instrument mode. Since the instrument settings for $A_0$ and $A_i$ are probably different, the flux of ions through at least a portion of the instrument will be different for $A_i$ compared to $A_0$, and Eq. 1 will not be valid.

Figure 2:
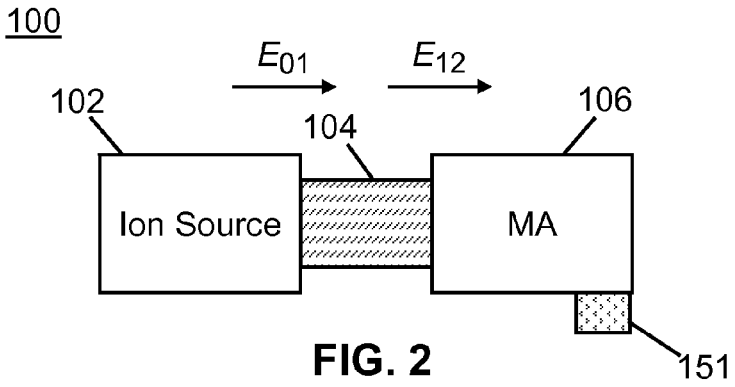
FIG. 2 is a schematic representation of a first mass spectrometer system illustrating transfer efficiencies between and across various components.

For example, consider the single-mass-analyzer instrument system represented by FIG. 2, which is a highly generalized and schematic diagram of a simple mass spectrometer system 100. Thus, in a basic sense, the mass spectrometer system 100 comprises an ion source 102 for generating ions from an introduced sample (not shown), a mass analyzer 106 (MA) coupled to a detector 151 for separating and detecting ion species, respectively, and ion transfer optics 104 to guide and focus the generated ions along a path from the ion source to the mass analyzer 106. The three basic components (ion source, ion transfer optics and mass analyzer) illustrated in FIG. 2 may be considered to be three different regions of ion transfer—a first region (or region #0), a second region (or region #1) and a third region (or region #2), respectively. Each transfer of ions between regions or across a region is associated with a respective efficiency, E, where E=1 represents perfect transfer and E=0 represents no transfer. Thus, for example, the combined efficiencies of transfer of ions from the ion source region 102 into the ion optics transfer region 104 and through the ion optics may be represented as $E_{01}$. Likewise, the combined efficiencies of transfer of ions from the ion optics into the mass analyzer 106 and through the mass analyzer to the associated detector 151 may be represented as $E_{12}$.

In the inclusive mode for $A_0$, various instrument parameters will be set to transmit a wide range of mass-to-charge. The radio frequency (RF) ion guides which may be employed in the ion transfer region 104 are typical examples, such as an ion funnel in the ion source or RF multipoles in the transfer region 104. A change in parameter settings will change the efficiencies of ion transfer, $E_{01}$ and $E_{12}$. However, if these efficiencies can be measured as a function of parameter setting, then Eq. 1 can be modified to Eq. 2, where the new variables $P_i$ and $P_0$ are the instrument parameters for the respective modes, and $E_r(P_i)$ is the efficiency through region R as a function of parameters $P_i$.

$$t_i = \frac{E_{01}(P_0)}{E_{01}(P_i)} \frac{E_{12}(P_0)}{E_{12}(P_i)} \frac{t_0}{I_0} I_{target} \quad \text{Eq. 2}$$

If the efficiencies cannot be measured directly, then the efficiency ratios can be replaced with parameterized intensity ratios (Eq. 3), where $I(P_i)$ is the intensity of an analyte using parameters $P_i$.

$$t_i = \frac{I(P_0)}{I(P_i)} \frac{t_0}{I_0} I_{target} \quad \text{Eq. 3}$$

Data representing a function or set of functions is stored in computer memory for the parameterized efficiency or intensity ratios, and the appropriate ratio is retrieved during an experiment to estimate the accumulation time. The mass-to-charge of the analyte(s) of interest in $A_i$ is typically one of the parameters.

Figure 3:
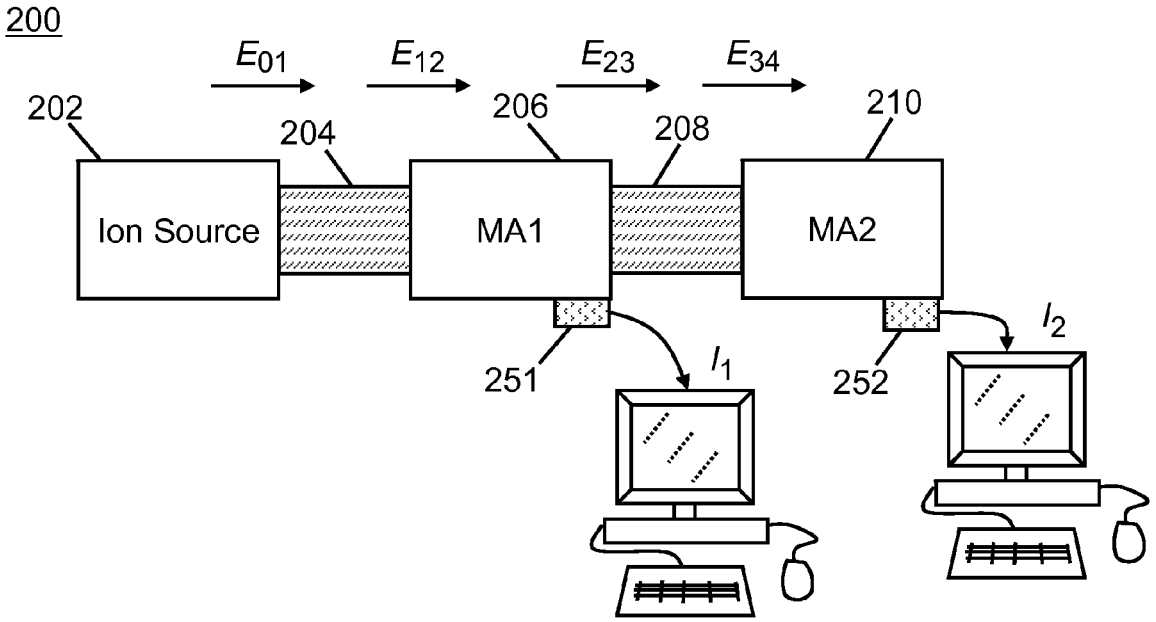
FIG. 3 is a schematic representation of a second mass spectrometer system comprising a hybrid system having first and second mass analyzers and illustrating transfer efficiencies between and across various components.

Another possible instrument configuration is a hybrid type, which includes more than one type of mass analyzer, as shown in FIG. 3. The system 200 shown in FIG. 3 comprises ion source 202 (Region #0), a first set of ion transfer optics 204 (Region #1—a first ion transfer region), a first mass analyzer, MA1 206 (Region #2) including detector 251, a second set of ion transfer optics 208 (Region #3—a second ion transfer region) and a second mass analyzer, MA2 210 and its associated detector 252. The efficiency variables $E_{01}$ and $E_{12}$ are defined as described above. The efficiency variables $E_{23}$ and $E_{34}$ are defined similarly. For example, the efficiency $E_{23}$ represents the combined efficiencies of transfer of ions from MA1 206 into the ion optics transfer region 208 and through ion optics transfer region 208. An example of this type of instrument is a QIT-OT combination, where MA1 206 may be the QIT and mass MA2 210 may be the OT. A typical operating mode uses MA2 for the survey acquisition $A_0$ and MA1 for the dependent acquisition $A_i$.

The variables $I_1$ and $I_2$ shown in FIG. 3 are the intensity values measured with each the first and second mass analyzer, respectively. In this case, besides the efficiency or intensity ratios of Eqs. 2 and 3, the transfer function needs to be known for converting measured intensity in MA2 to intensity in the target units in MA1. This is because not all mass analyzers output intensity values in units of ions/second. In this case, Eq. 3 would be modified to Eq. 4, as shown below, where the quantity $AR_{21}(I_0)$ is the analyzer ratio transfer function for converting intensity $I_0$ measured with MA2 into the target intensity units of analyzer MA1. Mass-to-charge may also be a parameter of the analyzer ratio function. The intensity ratio has been written as $\{I_{02}(P_0)/I_{02}(P_i)\}$, where intensity, I is measured with MA1 for both numerator and denominator, where this ratio represents the transfer efficiency through regions 0 to 2. The efficiency from region 2 to 4 can be measured and included separately, or included implicitly as part of $AR_{21}$.

$$t_i = \frac{I_{02}(P_0)}{I_{02}(P_i)} \frac{t_0}{AR_{21}(I_0)} I_{target} \quad \text{Eq. 4}$$

Figure 4:
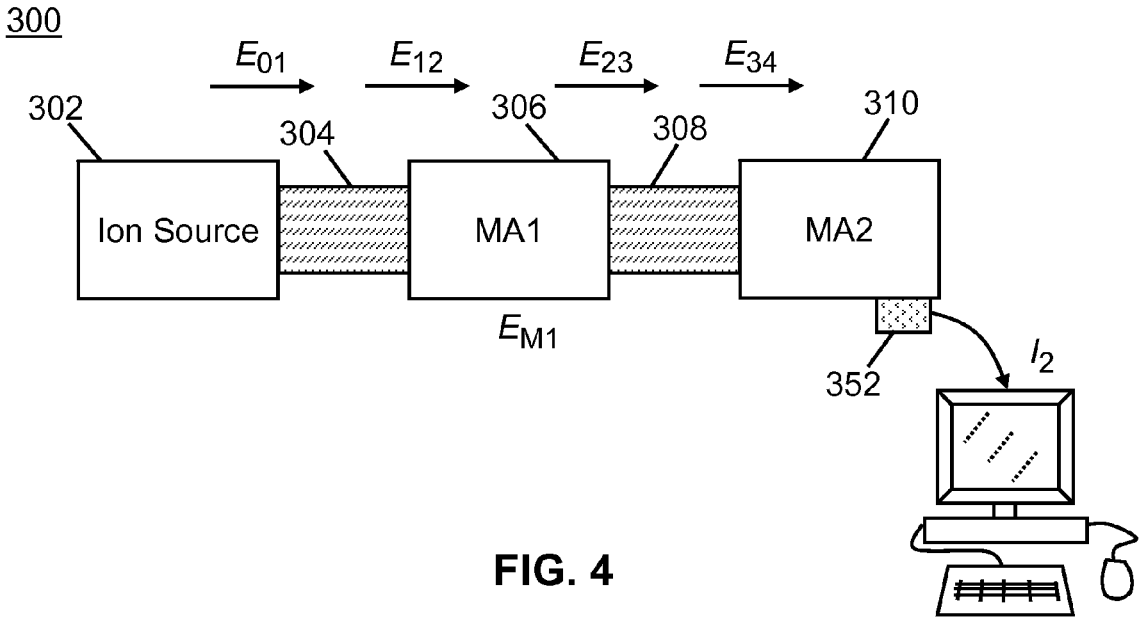
FIG. 4 is a schematic representation of a third mass spectrometer system comprising a hybrid system having first and second mass analyzers, where the first mass analyzer is a beam quadrupole mass filter and illustrating transfer efficiencies between and across various components.

Another type of system, as shown in FIG. 4, is similar to that shown in FIG. 3, except that, with regard to the system 300 shown in FIG. 4, the analyzer MA1 306 is a beam-type quadrupole mass filter (QMF), and, as a result, the intensity might never be measured with that analyzer. Other components shown in FIG. 4 are the ion source 302, the second mass analyzer 310 together with its detector 352 and first and second ion optics transfer regions 304, 308. In this case, the situation is somewhat similar to that shown in FIG. 2, in that MA1 is treated as just another optical element that the ions need to traverse along their path to MA2. The efficiency through MA1 is easy to measure, however, and Eq. 3 becomes Eq. 5 shown below. The efficiency through MA1 is given as $E_{MA1}(P_i)$, where, in this case, the inclusive mode for $P_0$ is assumed to have an efficiency of 1. This method can be amended for a Q-TOF type of instrument where, instead of accumulation time, the parameter being controlled is a degree of ion attenuation.

$$t_i = \frac{1}{E_{MA1}} \frac{I_{04}(P_0)}{I_{04}(P_i)} \frac{t_0}{(I_0)} I_{target} \quad \text{Eq. 5}$$

Figure 5:
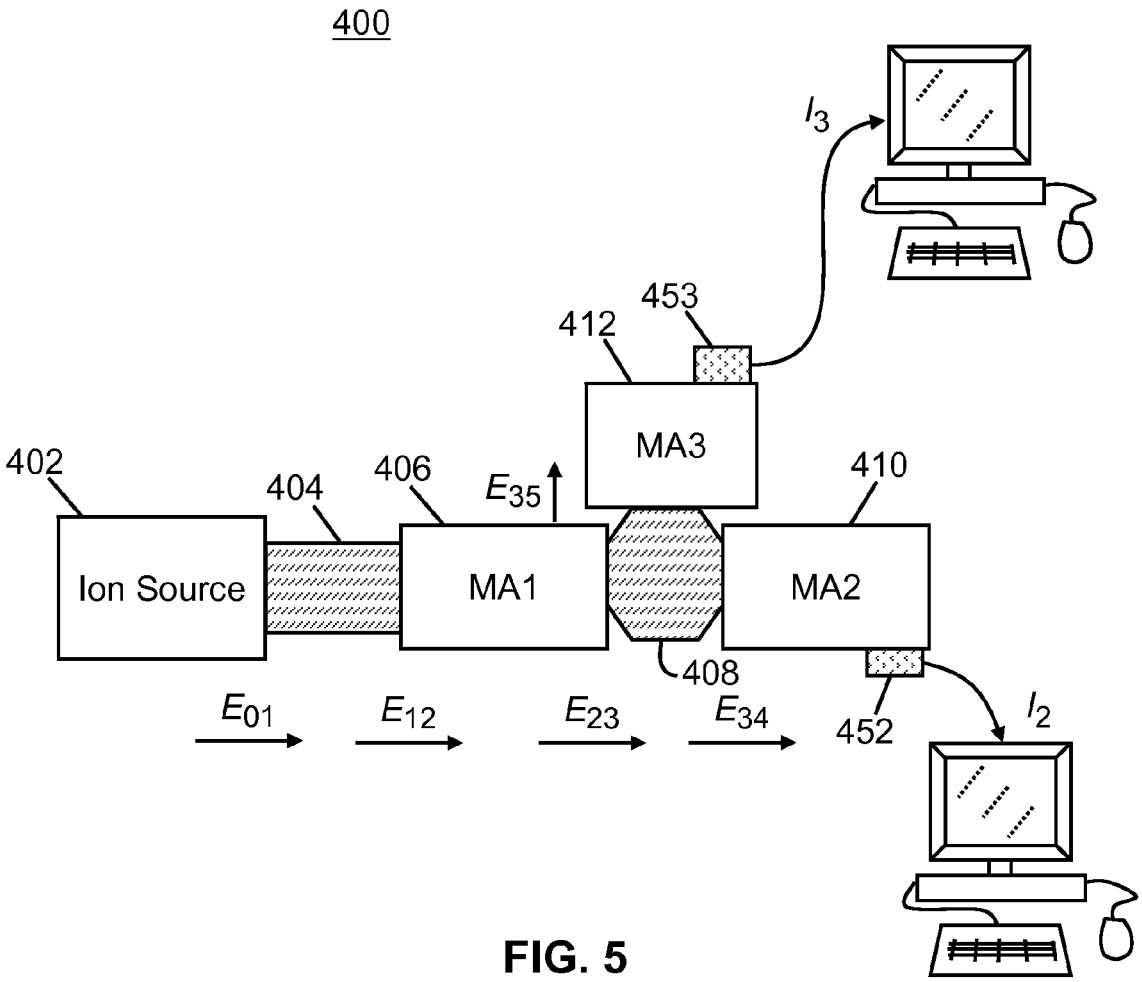
FIG. 5 is a schematic representation of a fourth mass spectrometer system comprising a hybrid system having first, second and third mass analyzers and illustrating transfer efficiencies between and across various components.

Another configuration to be considered is a hybrid instrument with three mass analyzers, as illustrated by the system 400 shown in FIG. 5. An example of this configuration is one in which MA1 406 is a QMF, MA2 410 is a QIT, and Mass Analyzer 3 (MA3) 412 is an OT. Ions generated by ion source 402 are transferred to MA1 406 by means of ion optics transfer region 404. Ions emerging from MA1 may be transferred either to MA2 410 or MA3 412 by means of ion optics transfer region 408. Detector 452 detects ions separated by MA2; detector 453 detects ions separated by MA3. This instrument typically acquires survey scans with MA3, and dependent scans with MA2. The accumulation time may be estimated with Eq. 6. Eq. 6 s is similar to Eq. 5, except that, in Eq. 6, the analyzer ratio $AR_{32}(I_0)$ is included, which may also implicitly include the ratio $\{E_{35}(P_0)/E_{34}(P_i)\}$ $$t_i = \frac{1}{E_{MA1}(P_i)} \frac{I_{04}(P_0)}{I_{04}(P_i)} \frac{t_0}{AR_{32}(I_0)} I_{target} \quad \text{Eq. 6}$$

Figure 6:
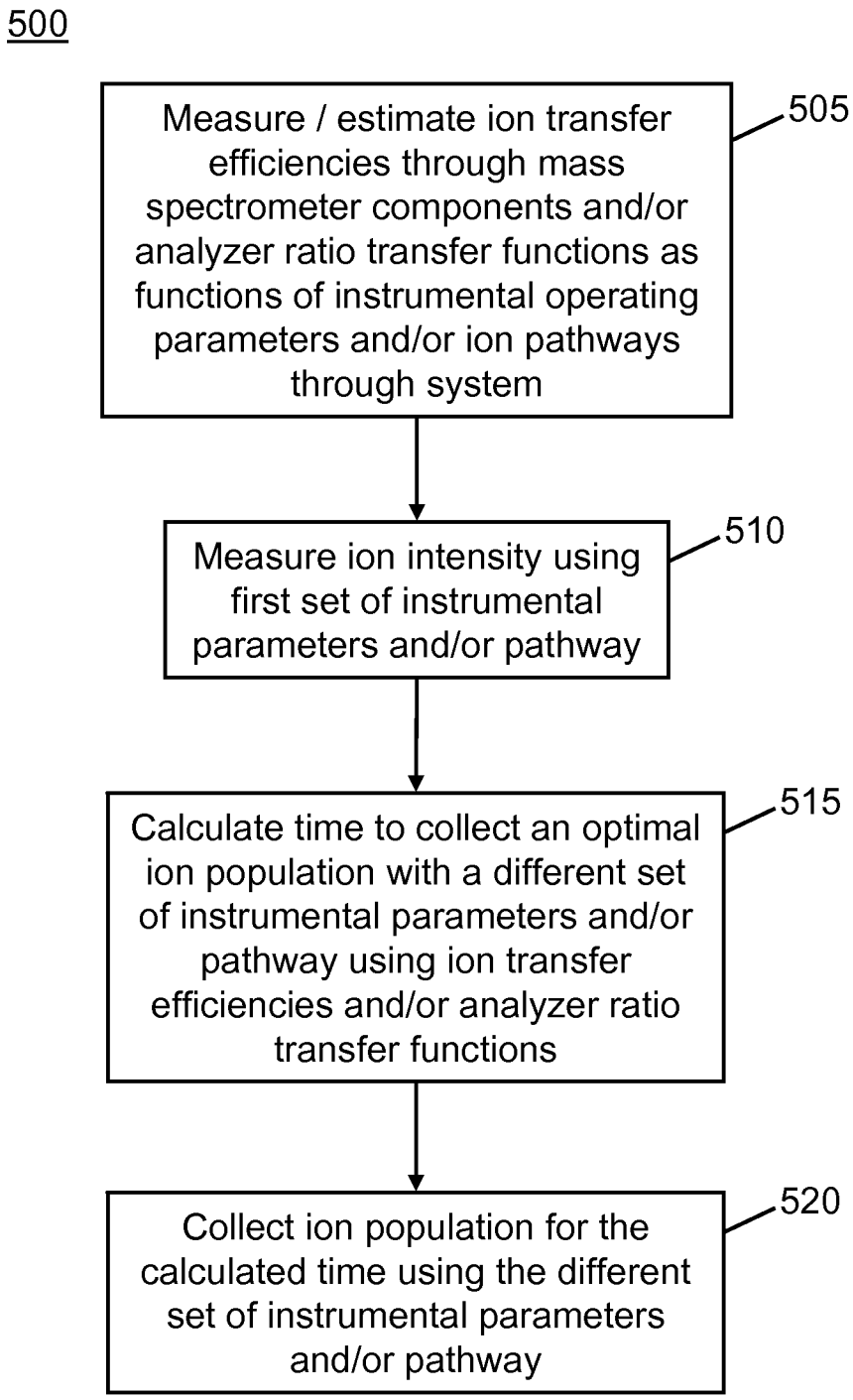
FIG. 6 is a flowchart of an exemplary method in accordance with the present teachings.

FIG. 6 is a flowchart of an exemplary method 500 for controlling ion population in a mass spectrometer in accordance with the present teachings. In a first step, Step 505, ion transfer efficiencies through mass various spectrometer components (or regions) are determined as functions of varying instrumental operating parameters or different alternative ion pathways through the mass spectrometer system (or both). Analyzer ratio transfer functions, which are factors required to convert intensity values measured with a mass analyzer used for preliminary survey acquisitions into the target intensity units of a different mass analyzer used for dependent acquisitions, may also be determined in this step. In some instances, ion transfer efficiencies may be directly measured; in other instance, efficiency ratios may be replaced by parameterized measured intensity ratios. The mass-to-charge ratio of ions to be detected may be considered to be or treated as an instrumental parameter, since these mass-to-charge ratios vary with varying instrumental settings.

In Step 510 of the method 500 (FIG. 6), a survey acquisition is made for a particular sample, in which one or more detected ion intensities are measured using a first set of instrumental parameters or a first ion pathway through the mass spectrometer system or both. The ion pathway will direct the ions to a particular mass analyzer and its associated detector, from which the one or more intensities are measured. If the pathway is one of two or more alternative pathways, then the alternative pathways may be associated with different mass analyzers and detectors.

In Step 515 of the method 500 (FIG. 6), a time required to collect, during a dependent acquisition, an optimal population of ions in the mass spectrometer system is calculated, where the calculated time applies to the use of a different set of instrumental parameters or a different pathway (or both) than used for the survey acquisition. This calculation is performed using the ion transfer efficiencies or analyzer ratio transfer functions (or both) determined in Step 505 as well as the detected intensities measured in Step 510. The calculation may be performed using the equations presented above or equations similar to those shown. The different set of instrumental parameters may include a mass-to-charge ratio or range that is different from that of the ions detected in the survey acquisition performed in step 505. The different set of instrumental parameters may include an ion pathway through the system or a mass analyzer that is different from the pathway or analyzer employed during the survey acquisition. If the mass analyzer is different, then the appropriate analyzer ratio transfer functions, as defined above, may need to be employed in the calculation. Finally, in Step 520, the optimal ion population is collected within the mass spectrometer system by collecting ions for the calculated time using the different set of instrumental parameters or pathway or both.

The problem of dis-similar isolation efficiencies of different mass analyzers is now considered. This problem can be solved if the isolation efficiency profile of the analyzer used in the $MS^n$ stages can be characterized. If the efficiency as a function of mass offset from an isolation center mass is known, then the actual ion flux in the dependent scans can be estimated with increased accuracy. If the analyzer used for isolation in the first stage of MS/MS is, for example, a quadrupole mass filter (QMF), then the normalized transmission efficiency profile can be fit with an exponential function, such as Eq. 7, where p(m) is transmission as a function of mass offset.

$$p(m)=e^{(b*(m-c)^6)}(d+f*m) \qquad \text{Eq. 7}$$

Figure 7:
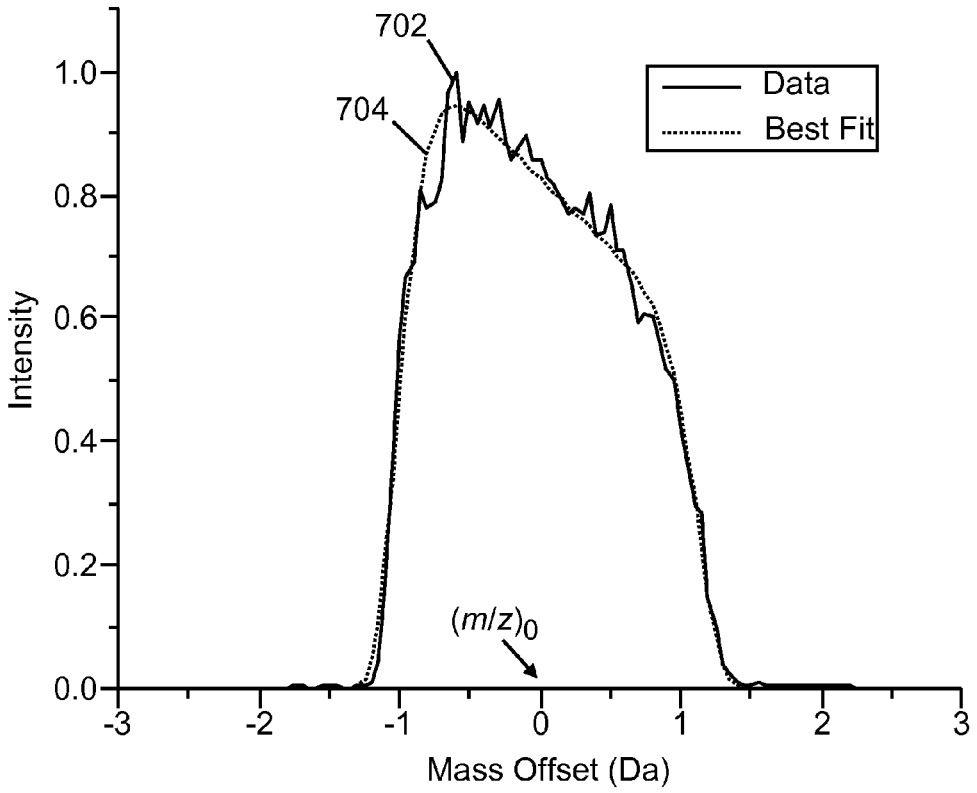
FIG. 7 is a graph of the transmission of an ion species of a single mass-to-charge (m/z) ratio through a quadrupole mass filter (QMF) as a function of varying the central isolation m/z of the QMF across the m/z ratio of the ion species.
Figure 8:
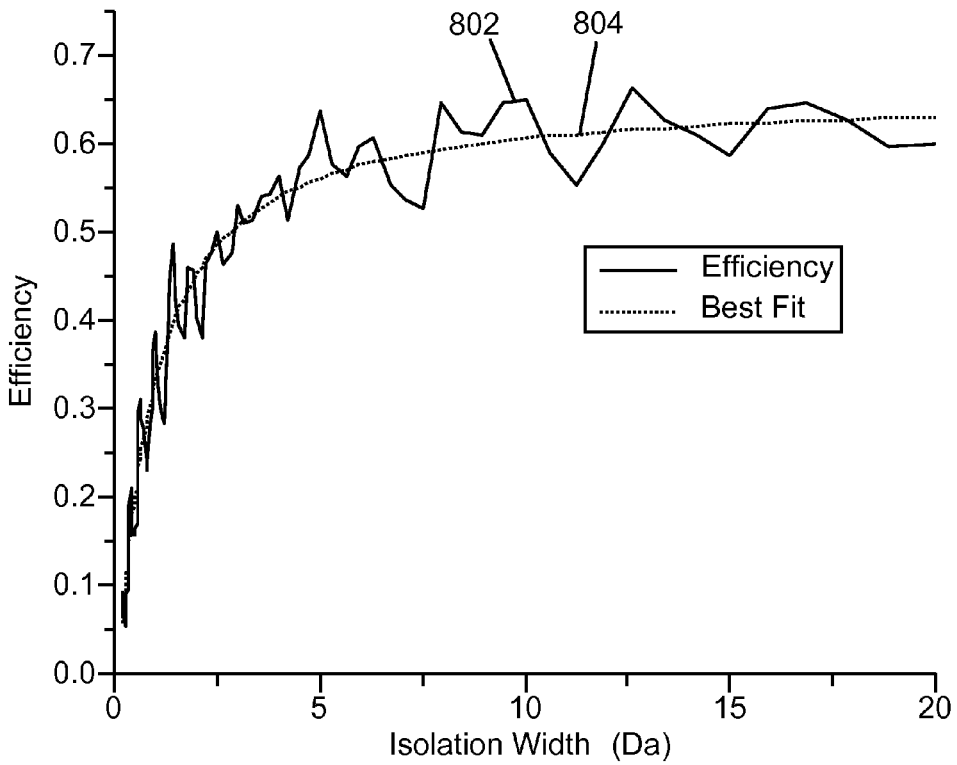
FIG. 8 is a graph of the transmission efficiency through a QMF operated with the central m/z of the QMF at zero offset from an isolation window, as a function of isolation width.
Figure 9:
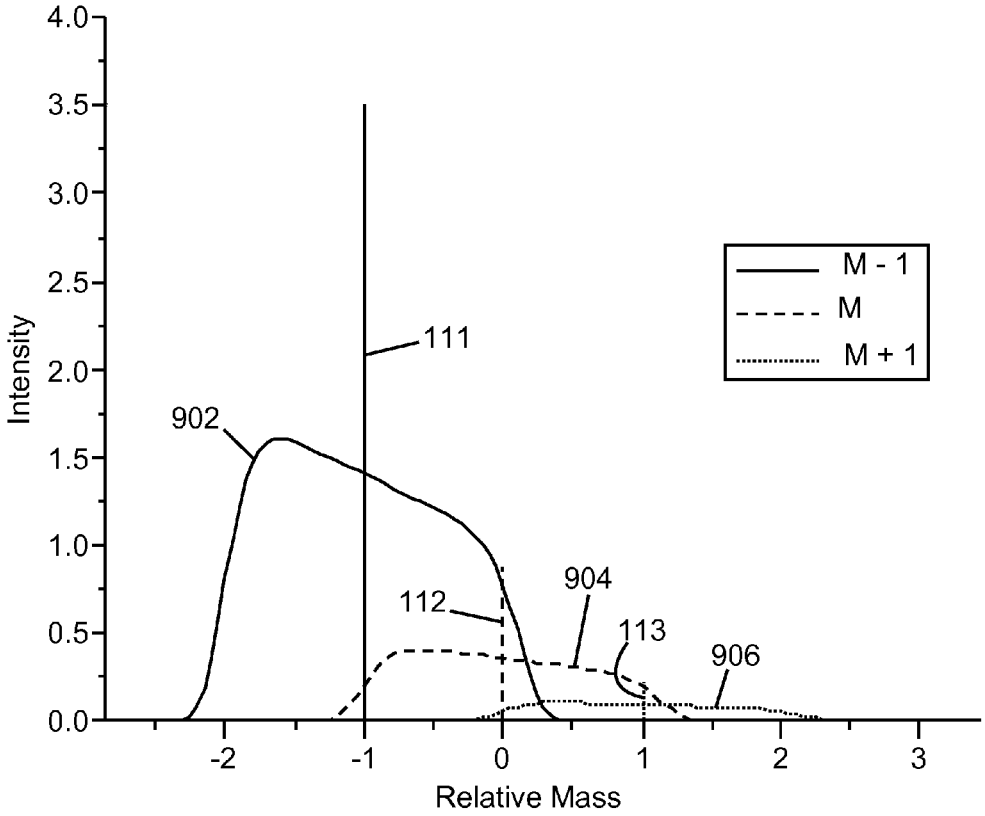
FIG. 9 is calculated transmission intensity generated by convolution of survey-scan centroid peaks together with scaled QMF transmission profiles.

FIG. 7 is an example of a QMF transmission profile that was recorded by varying the center mass of the QMF and monitoring the abundance of a single mass in another analyzer, a quadrupole ion trap (QIT). The measured transmission profile 702 is not perfectly rectangular, as expected for an ideal QMF, but has a slope on the top of the peak. If a suitable equation cannot be found to derive a best-fit model curve 704 to approximate the profile, then a look-up table of values could be stored to represent the transmission. The profile should be characterized for different QMF transmission widths, and masses. In some cases, the profile may have no mass dependence. If the transmission profiles for a set of isolation widths have been characterized, then the profile for any other arbitrary isolation width can be approximated using interpolation.

Practically, the transmission profiles can be normalized to 1, and the transmission efficiency at 0 offset can be characterized in a separate experiment, using a fine incremental scan of isolation width. An example set of such measured transmission efficiency data 802 is given in FIG. 8, where the isolation width was varied from 0.2 to 20 Da. The data were fit by curve 804 according to the model of Eq. 8 below, where w is isolation width. Similar to Eq. 7, the transmission efficiency at 0 offset can be characterized for a series of different masses, and for any particular mass, a suitable estimation of efficiency can be approximated using interpolation.

$$t(w) = \frac{a-b}{1+(w/c)^d} + b \qquad \text{Eq. 8}$$

Figure 1:
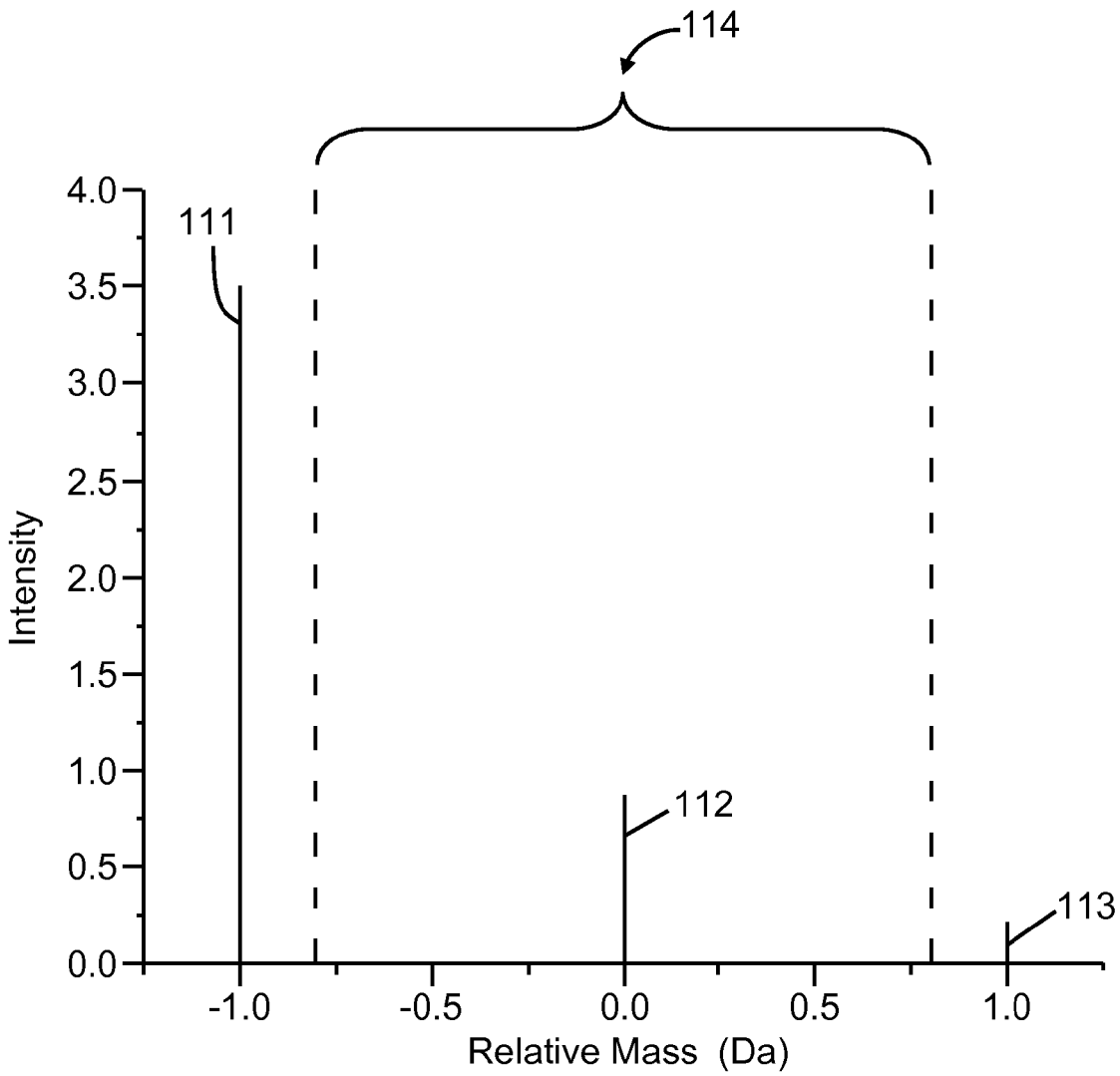
FIG. 1 is a graph of a hypothetical survey mass scan, having an ion species at mass 0.0 Da that is targeted for isolation, and including interference ions at −1.0 and +1.0 Da.

Finally, a more accurate estimation of ion flux through the QMF can be estimated from the survey scan if the survey scan centroid peaks are convolved with the appropriate, scaled, transmission profile which may be measured and modeled as noted above. An example is given in FIG. 9, where the same peaks 111, 112 and 113 from FIG. 1 are convolved with the transmission profile for a 2 Da isolation window so as to generate calculated transmission intensity curves 902, 904 and 906, respectively. The estimated signal intensity of any of the survey scan species after passage through the QMF is found from the value of the transmission profile at the center of the isolation window. Eq. 9 summarizes the process, where I(c, w) is total estimated intensity for isolation center mass c and isolation width w, $P_{m_i}(c-m_i)$ is the transmission profile for mass $m_i$ in the survey scan at offset $c-m_i$ and $t_{m_i}(w)$ is the transmission efficiency at 0 mass offset for mass $m_i$. Since the various masses $m_i$ are all near the isolation center mass, the functions $p_c(c-m_i)$ and $t_c(w)$ can be used instead of $p_{m_i}(c-m_i)$ and $t_{m_i}(w)$.

$$I(c, w) = \sum_{i=1}^{n} p_{m_i}(c-m_i)t_{m_i}(w) \qquad \text{Eq. 9}$$

Figure 10:
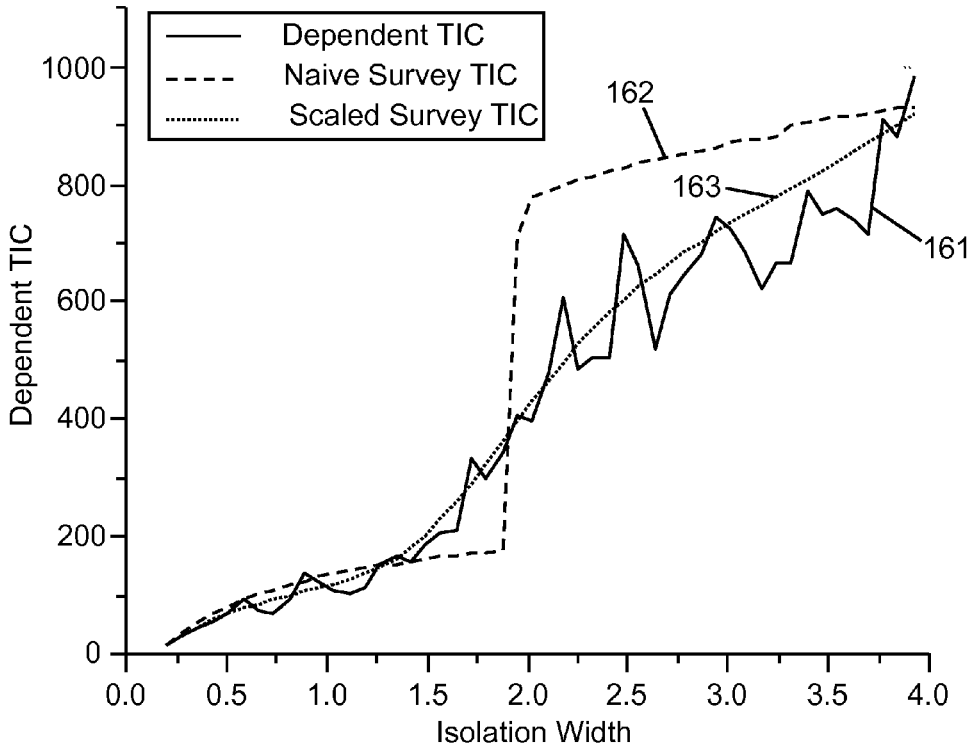
FIG. 10 is the result of a test case of the methods of the present teachings, in which total ion current (TIC) is measured or calculated with regard to the isolation of MRFA $^{13}C$ on at various isolation widths, wherein the measured TIC data is shown with the solid-line trace, centroid estimation of the TIC is shown with the dashed-line trace, and the calculated TIC using Eq. 9 is shown with the dotted-line trace.

The benefit of the procedure outlined by this disclosure can be appreciated with a simple experiment, the results of which are illustrated in FIG. 10. A cluster of isotopes for the peptide MRFA (m/z 524) was used as a model system, and the isolation window was centered at the A+1 peak as the species of interest. The A and A+2 peaks serve as interference species. First a survey scan at very wide isolation width is performed, and the intensities of the peaks are recorded. Then, dependent scans are taken at a series of isolation widths. For each isolation width, the actual total ion current (TIC) is recorded with the solid-line trace 161. The dashed-line trace 162 is the estimated TIC using the sum of survey scan centroids within the isolation window, scaled by $t_{m_i}(w)$. Note the presence of the discontinuity at width 2.0, where the intensities of A and A+2 are both included in the isolation window. The dotted-line trace 163 is the estimated dependent TIC calculated using Eq. 9. Note that the error in the dashed-line trace reaches a maximum of 100% when the edges of the isolation window fall on top of the interference ions A and A+2. In any real data dependent experiment, the interference ions will, of course, have random positions relative to the species of interest. Nonetheless, the procedures outlined in this disclosure will ensure that the estimation of ion intensity remains accurate.

EXAMPLE

Figure 11:
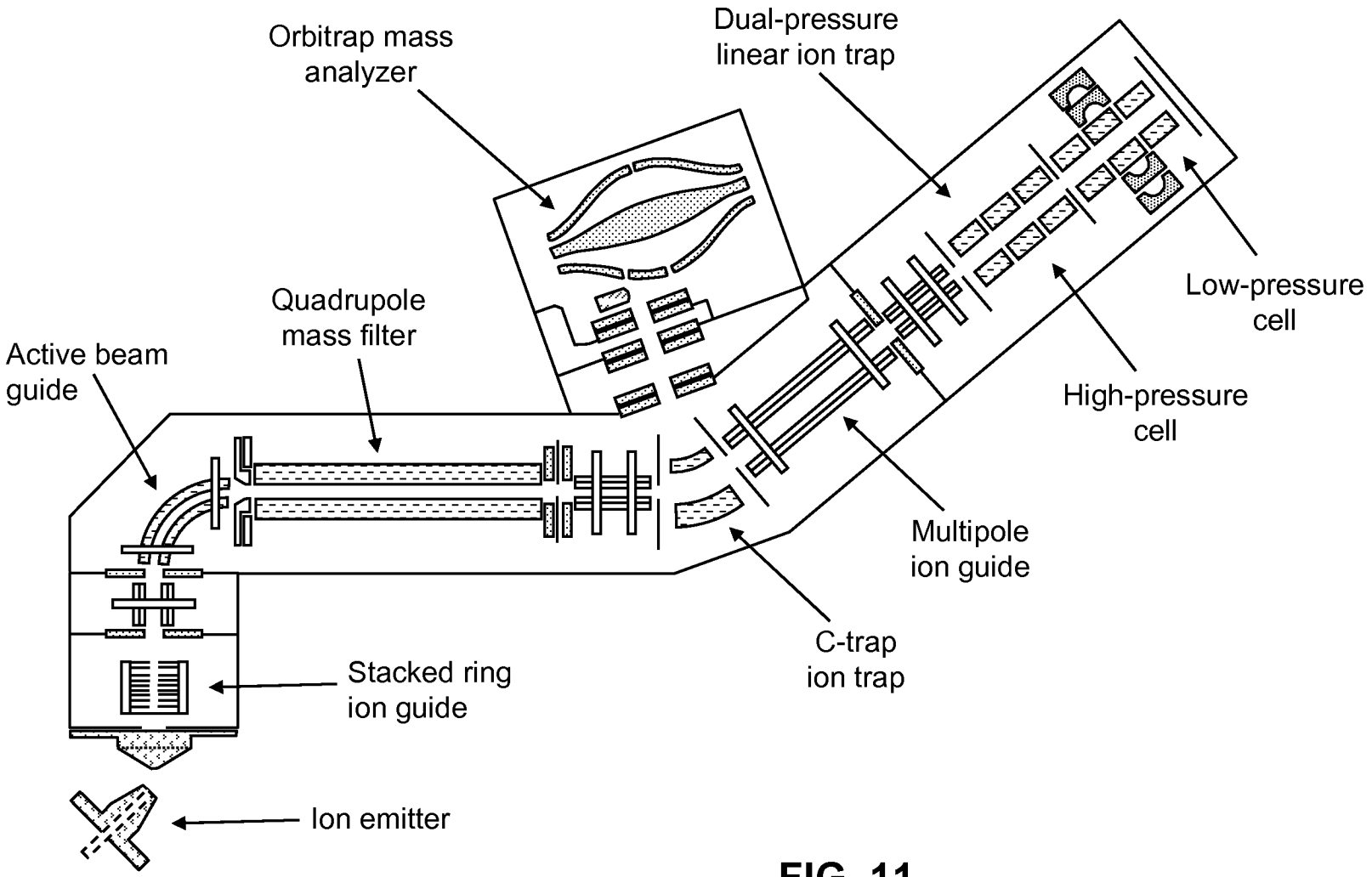
FIG. 11 is a schematic depiction of the instrument layout of a mass spectrometer employed in conjunction with methods according to the present teachings.

A series of data-dependent liquid chromatography/mass spectrometry (LC/MS) mass spectra were obtained of a 1 μg yeast tryptic digest using a Thermo Scientific™ Orbitrap Fusion™ Tribrid™ mass spectrometer manufactured by Thermo Fisher Scientific of Waltham, Mass. USA. A schematic diagram of the instrument is depicted in FIG. 11. A key performance characteristic of this instrument is its high duty cycle, which is realized by efficient scan scheduling, so that master scans are acquired with one analyzer while dependent $MS^n$ scans are acquired with the other analyzer. Using this instrument, the Orbitrap™ analyzer, which is a type of electrostatic trap analyzer, is typically used as the master analyzer that performs the survey scans. The Orbitrap™ mass analyzer employs image charge detection, in which ions are detected indirectly by detection of an image current induced on an electrode by the motion of ions within an ion trap. In this type of analyzer, very low abundance species have systematically low intensity values, especially in complex mixtures like peptide digests. Thus, the very low abundance ion species may be undetected by the master analyzer. These ion species, although not-observed, nonetheless contribute to space charge effects and are here termed "mass spectrometric dark matter". To accurately assess the true ion abundance for a given isolation window, a "dark matter correction" was developed in accordance with the following procedure.

Figure 12:
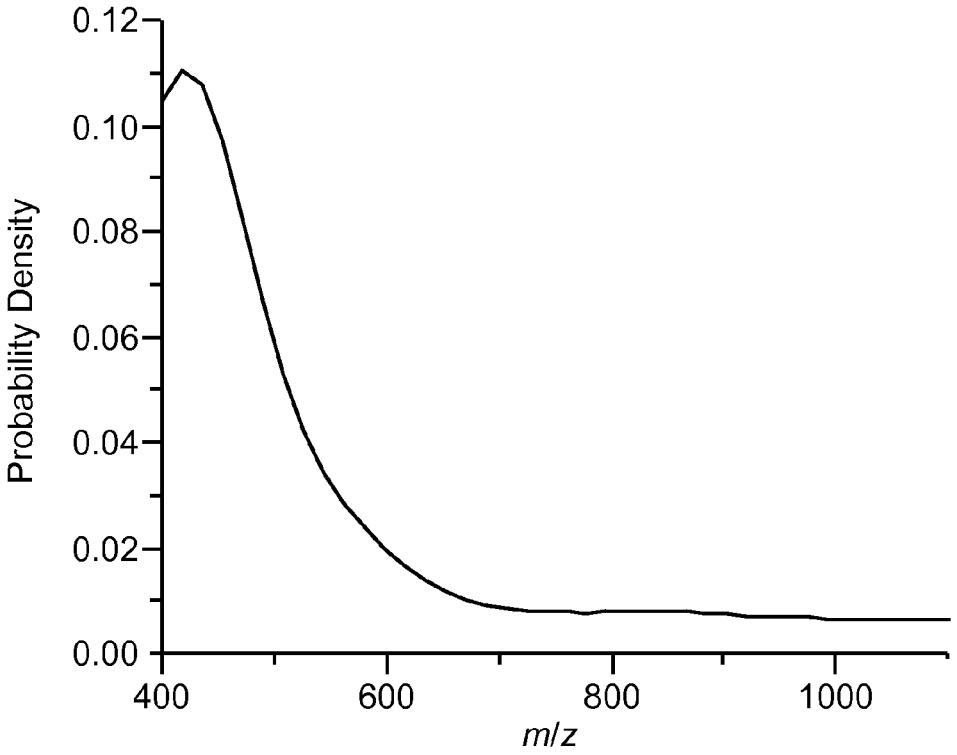
FIG. 12 is a graph of a probability density function relating to the probability of observing ion species in the Orbitrap™ component of the mass spectrometer system of FIG. 11, as calculated from a filtered running average of scan intensities measured by the Orbitrap™.

The dark matter correction assumes that the number of ions actually within the Orbitrap analyzer is truly the AGC target, as regulated by the ion trap. It is further assumed that, of these ions in the Orbitrap analyzer, D are not observed, but have probability density function (p.d.f.) given by g(m), calculated from a filtered running average of master scan intensities (FIG. 12). Then the corrected ion abundance A is found with Eqs. 10 and 11 below:

$$D = \text{Target} - \text{FT_TIC} \cdot \left( \frac{\text{ions}}{ftSignalUnit} \right) \quad \text{Eq. 10}$$

$$A = \sum_{i=m_1}^{m_2} f(m_i) + D \sum_{i=m_1}^{m_2} g(m_i) \quad \text{Eq. 11}$$

in which the quantity D is the number of undetected ions, A is the estimate of the actual amount of precursor ions, f(m) is the area measured by the Orbitrap analyzer, g(m) is the p.d.f. of mass spectrometric dark matter and $m_1$ and $m_2$ are isolation windows.

As a test of the dark matter correction, low concentration bovine serum album digest was infused as a simple demonstration of the method of calculating mass spectrometric dark matter, with 500 ms maximum injection time. The actual number of ions in the dependent scans was plotted as a function of master scan precursor intensity. The mass spectrometric dark matter correction shifts the estimated Orbitrap full scan intensities (e.g., $I_0$ in Eq. 1) upward (Eq. 11), which gives a lower injection time that is more accurate. The instrument cycle time is also improved. In the instant example, 899 dependent scans were acquired with the correction off, versus 2557 with the correction on, in the same total amount of experiment time.

Typically the ion trap is not used as the master analyzer on the Q-OT-QIT, because the mass accuracy and resolution is lower. However, there are some experiments where ion trap full scan data are used for calculating dependent scan injection times, such as the data independent acquisition (DIA) experiment.

Figure 13:
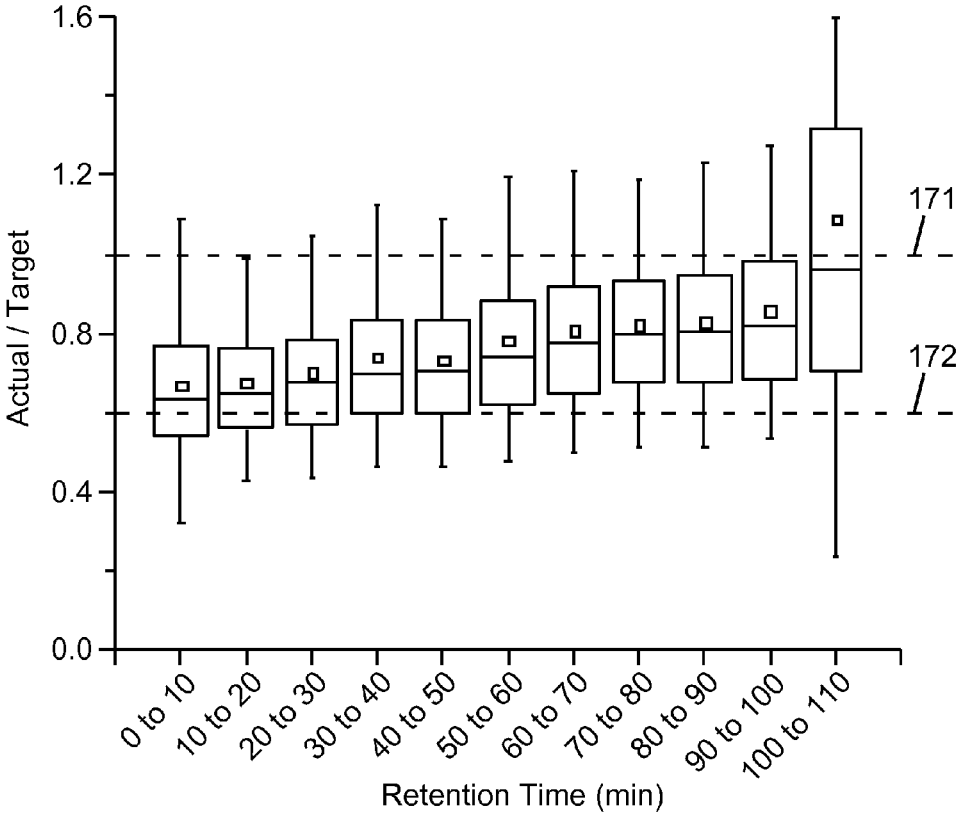
FIG. 13 is a chart the ratio of Actual/Target number of ions versus retention time for experiments performed using injection time estimates based on ion trap survey scans.

Because single ions are measured with the ion trap, the actual number of dependent ions is accurately regulated, as shown in FIG. 13. This figure provides a graphical depiction of the distribution of measured values of the ratio of the actual number of observed ions to the targeted number of ions. In both FIG. 13 and FIG. 14, the lower and upper edges of each elongated box respectively represent 25-percentile and 75-percentile points of a distribution of measurements, the middle line of each box represents the median of the respective distribution, and the smaller square in the box represents the mean of the respective distribution. The "whiskers" at the lower and upper edges of each vertical line are 5-percentile and 95-percentile markers, respectively. The data in FIG. 13 was obtained for an LC/MS analysis of 500 ng *C. elegans* tryptic digest. The maximum injection time was 35 ms, the target value was 10000, and only injection times that did not reach the maximum injection time were included in the analysis. Since collision-induced dissociation (CID) efficiency is typically ~60%, the expectation is for values around 0.6. Line 171 represents a value of unity for the ratio and line 172 represents a ratio value of 0.6.

Figure 14A:
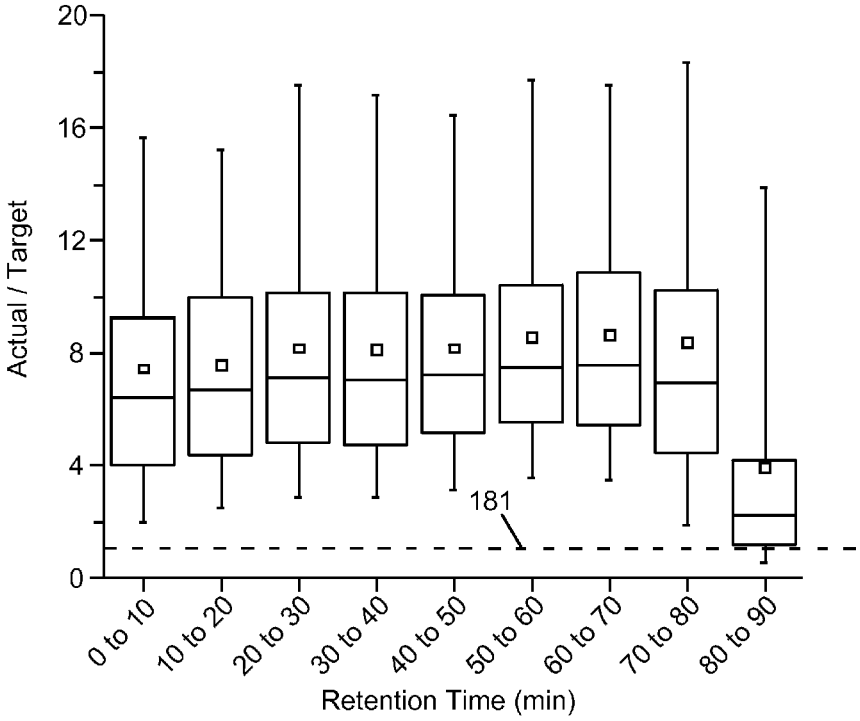
FIG. 14A is a chart the ratio of Actual/Target number of ions versus retention time for experiments performed using injection time estimates based on Orbitrap survey scans, with the Orbitrap dark matter correction OFF.
Figure 14B:
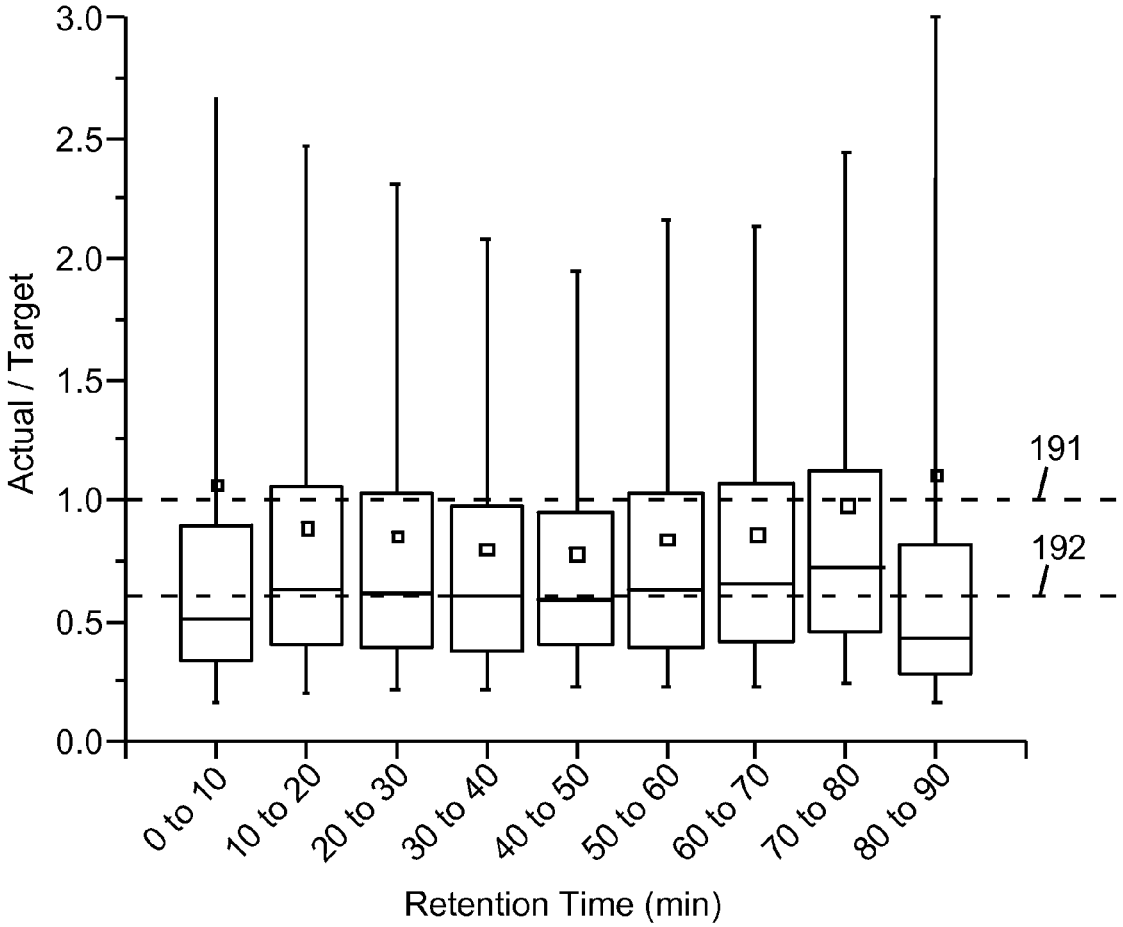

FIG. 14 is a graphical depiction of the distribution of measured values of the ratio of the actual number of observed ions to the targeted number of ions determined for data-dependent experiments using the Orbitrap as the master analyzer, with the dark matter correction both on and off. The LC/MS analyses were performed on 1 μg yeast tryptic digest, with a target value of 10000 and 200 ms maximum injection time. Only injection times that were known not to overfill the trap were included in the analysis. Line 181 in FIG. 14A and line 191 in FIG. 14B represent a value of unity for the ratio of actual to targeted number of ions. Line 192 in FIG. 14B represents a ratio value of 0.6. FIG. 14A shows that, without the dark matter correction, the average ion population was about six times higher than the requested target. FIG. 14B demonstrates that with the dark matter correction on, the ion population was regulated closely near the requested target.

Figure 15:
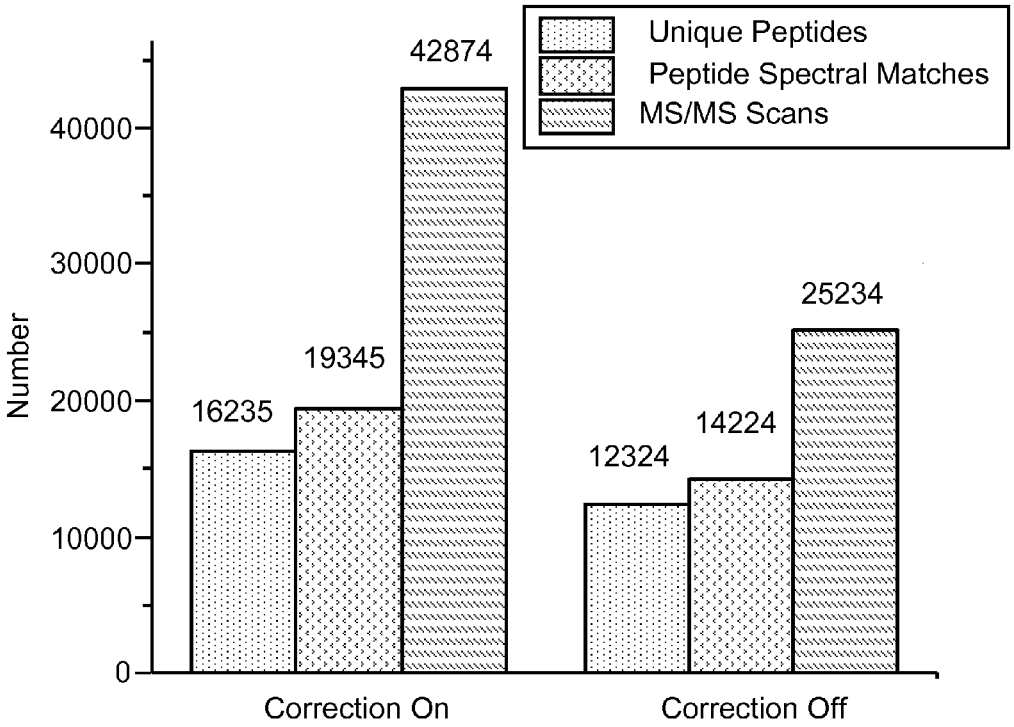
FIG. 15 is a bar chart of total MS/MS analyses and peptide recognitions and identifications showing a comparison of results with the Orbitrap mass spectrometric dark matter correction both ON and OFF.

The data-dependent data were searched using peptide identification software, with the results shown in FIG. 15. Using the dark matter correction keeps the injection times lower, which results in 1.7 times more MS/MS acquisitions, 1.3 times more peptide spectral matches, and 1.3 times more unique peptide identifications.

In summary, new predictive automatic gain control methods have been disclosed herein for use with hybrid mass spectrometer systems, which include more than one type of mass analyzer. Transmission through the instrument can be characterized and parameterized. Thus, ion flux for one instrument state is predicted from the ion flux in another instrument state. Centroids determined using a first mass analyzer of the hybrid mass spectrometer may be convolved with peak shapes characteristic of another one of the mass analyzers in order to improve the accuracy of ion flux and ion injection time estimations accuracy. According to the methods, differences between analyzer sensitivities can be accounted for with a "mass spectrometric dark matter" correction algorithm in order to account for undetected ion species that contribute to charge density. Without the correction, injection time estimates are too high (~6×), and the instrument scan rate is lower. However, using the correction, injection times are accurately estimated, and the instrument scan rate is higher, leading to more peptide identifications.

The discussion included in this application is intended to serve as a basic description. Although the present invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the spirit, scope and essence of the invention. Neither the description nor the terminology is intended to limit the scope of the invention. Any publications, patents or patent application publications mentioned in this specification are explicitly incorporated by reference in their respective entirety.

What is claimed is:

1. A method for performing a mass analysis of a subset of ions generated from a sample, the subset of ions comprising a restricted range mass-to-charge (m/z) ratios of the generated ions, the method comprising the steps of (i) performing a survey mass analysis, using a first mass analyzer that employs indirect detection of ions by detection of an image current induced on an electrode by the motion of the ions within an ion trap, so as to identify the restricted range of m/z ratios and to measure a flux of ions having m/z ratios within said restricted range and (ii) performing a dependent mass analysis, using a second mass analyzer of the mass spectrometer, of an optimal quantity of ions having m/z ratios within said restricted range, said optimal quantity of ions collected for a time period determined by the measured ion flux, the method CHARACTERIZED IN THAT:

the time period is determined using a corrected ion flux that is calculated from the measured flux of ions;

wherein a calculation of the corrected ion flux includes a correction that comprises an estimate of the quantity of ions that are trapped in and undetected by the first mass analyzer.

2. A method for performing a mass analysis as recited in claim 1, FURTHER CHARACTERIZED IN THAT:

the calculation of the corrected ion flux includes multiplication of the measured ion flux by a factor calculated as the ratio between efficiency of ion transfer from an ion source to the second mass analyzer during the dependent mass analysis and efficiency of ion transfer from the ion source to the first mass analyzer during the survey mass analysis.

* * * * *